US006659172B1

(12) United States Patent
Dewar et al.

(10) Patent No.: US 6,659,172 B1
(45) **Date of Patent: *Dec. 9, 2003**

(54) ELECTRO-HYDRODYNAMIC HEAT EXCHANGER

(75) Inventors: Douglas MacGregor Dewar, Rolling Hills Estates, CA (US); Alexander F. Anderson, Rolling Hills Estates, CA (US)

(73) Assignee: AlliedSignal Inc., Morristown, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 46 days.

(21) Appl. No.: 09/280,775

(22) Filed: Mar. 29, 1999

Related U.S. Application Data

(60) Provisional application No. 60/080,728, filed on Apr. 3, 1998.

(51) Int. Cl.[7] ..... F28F 3/00

(52) U.S. Cl. ..... 165/166; 165/96; 165/135; 165/905

(58) Field of Search ..... 165/166, 96, 905, 165/135; 96/28, 30, 73; 95/59, 73, 67

(56) References Cited

U.S. PATENT DOCUMENTS

| | | | | | |
|---|---|---|---|---|---|
| 3,602,298 | A | * | 8/1971 | Ciesieiski | 165/135 X |
| 3,734,172 | A | * | 5/1973 | Clifford | 165/96 |
| 3,794,111 | A | * | 2/1974 | Blomaren, Sr. et al. | 165/96 |
| 4,183,403 | A | * | 1/1980 | Nicholson | 165/166 |
| 4,253,520 | A | * | 3/1981 | Friedericy et al. | 165/166 |
| 4,423,768 | A | | 1/1984 | Edelman et al. | |
| 4,515,206 | A | * | 5/1985 | Carr | 165/96 X |
| 4,577,678 | A | * | 3/1986 | Frauenfeld et al. | 165/905 X |
| 4,832,118 | A | * | 5/1989 | Scanlon et al. | 165/905 X |
| 5,072,780 | A | * | 12/1991 | Yabe | 165/96 X |
| 5,626,188 | A | * | 5/1997 | Dewar et al. | 165/905 X |
| 5,628,363 | A | | 5/1997 | Dewar et al. | |
| 5,655,600 | A | * | 8/1997 | Dewar et al. | 165/905 X |
| 5,769,158 | A | * | 6/1998 | Yao | 165/905 X |

FOREIGN PATENT DOCUMENTS

| | | | | |
|---|---|---|---|---|
| GB | 1163953 | | 9/1969 | |
| GB | 2101731 | | 1/1983 | |
| JP | 0233499 | * | 10/1986 | 165/96 |
| JP | 0229877 | | 12/1990 | |
| SU | 0939927 | * | 6/1982 | 165/96 |
| SU | 1521997 | * | 11/1989 | 165/96 |

* cited by examiner

*Primary Examiner*—Christopher Atkinson
(74) *Attorney, Agent, or Firm*—Oral Caglar, Esq.

(57) ABSTRACT

A heat exchanger includes a plurality of spaced-apart plates and a plurality of spacers that separate the plates. The plates and spacers cooperate to form hot-side and cold-side passageways. The plates are made of a thermally and electrically conductive material, and the spacers are made of an electrically non-conductive material. A voltage is applied across the plates to electro-hydrodynamically increase heat transfer efficiency of the heat exchanger.

15 Claims, 2 Drawing Sheets

ELECTRO-HYDRODYNAMIC HEAT EXCHANGER

This application claims the benefit of provisional application No. 60/080,728 filed Apr. 3, 1998.

BACKGROUND OF THE INVENTION

The present invention relates to heat exchangers. More specifically, the present invention relates to a heat exchanger that is electro-hydrodynamically enhanced.

In a typical heat exchanger, heat from a "hot" fluid is transferred to, and carried away by, a coolant. The typical heat exchanger is made of metal, which facilitates the transfer of heat from the hot fluid to the coolant. A bar and plate type heat exchanger made of metal is described in U.S. Pat. No. 5,183,106, which is assigned to the assignee of the present invention.

Heat exchangers can also be made of composite materials. See, for example, U.S. Pat. No. 5,628,363, which describes a plate-fin heat exchanger made of, carbon composite. Such composite heat exchangers also facilitate the transfer of heat from the hot fluid to the coolant. However, composite heat exchangers have lower thermal stresses and better corrosion resistance than heat exchangers made of metal. Composite heat exchangers can also be fabricated into complex geometries more easily than metal heat exchangers. U.S. Pat. No. 5,628,363, also assigned to the assignee of the present invention, is incorporated herein by reference.

However, heat transfer efficiency of heat exchangers in general is limited by the thermal conductivity of their structural materials (e.g., metal, composite). Heat transfer efficiency is also limited by the convective coefficient of the fluids flowing through the heat exchanger.

Increasing the heat transfer efficiency would allow size and weight of the heat exchanger to be reduced. Smaller, lighter, more efficient heat exchangers would be able to remove more heat than larger, heavier, less efficient heat exchangers. In the aerospace industry, for example, it is extremely desirable to increase the efficiency and reduce the weight of heat exchangers used on board aircraft. Reducing the weight reduces fuel consumption. Reducing fuel consumption, in turn, reduces the cost of operating the aircraft.

SUMMARY OF THE INVENTION

The present invention can be regarded as a heat exchanger that can be electro-hydrodynamically enhanced to increase heat transfer efficiency. The heat exchanger includes a plurality of plates stacked in a substantially parallel spaced-apart relationship, and a plurality of spacers located between the plates. The spacers and the plates cooperate to define hot-side and cold-side passageways. The plates are thermally and electrically conductive, and the spacers are electrically non-conductive. Such a heat exchanger allows an electric field to be placed across the plates. Applying the electric field causes the heat exchanger to be electro-hydrodynamically enhanced.

DETAILED DESCRIPTION OF THE INVENTION

Figure 1:
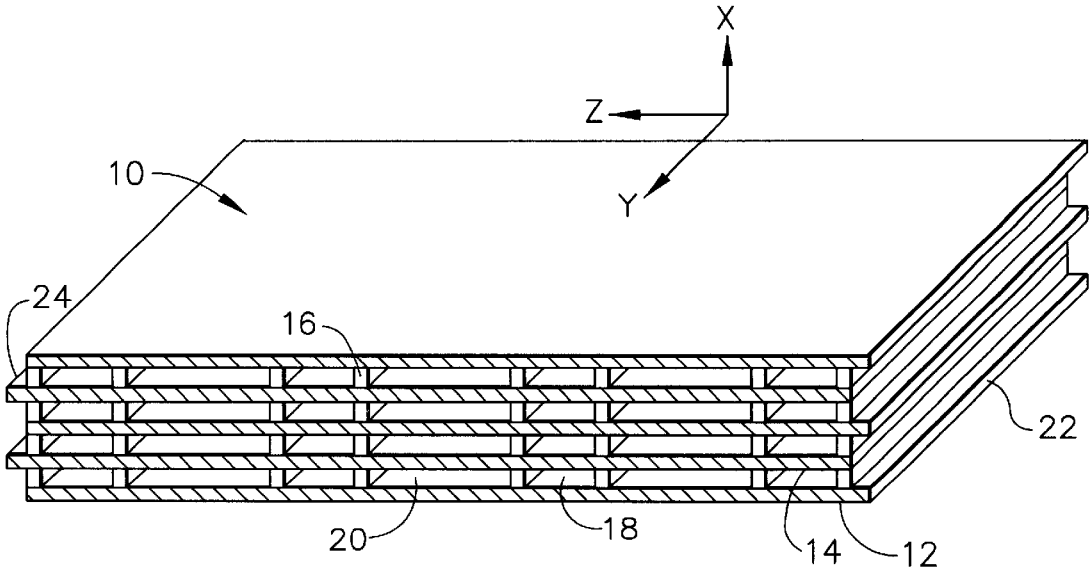
FIG. 1 is an illustration of a counter flow heat exchanger according to the present invention.

FIG. 1 shows a heat exchanger 10 including a stack of flat parallel plates 12 and 14 that are thermally conductive. The plates 12 and 14 are stacked in a substantially parallel, spaced-apart relationship. The heat exchanger 10 further includes a plurality of spacers 16 located between the plates 12 and 14. In addition to separating the plates 12 and 14, the spacers 16 cooperate with the plates 12 and 14 to define hot-side passageways 18 and cold-side passageways 20. The passageways 18 and 20 can be arranged in rows and columns. In FIG. 1, the passageways 18 and 20 are shown as being arranged in a counterflow configuration, which provides either counter or parallel flow. The passageways 18 and 20 are of sufficient size to accomplish the desired overall transfer of heat from a hot fluid flowing through the hot-side passageways 18 to a coolant flowing through the cold-side passageways 20.

The plates 12 and 14 are made of a material that is electrically conductive as well as thermally conductive. The plates 12 and 14 can be made of a metal such as aluminum, copper or stainless steel. In the alternative, the plates 12 and 14 can be made as a carbon composite or carbon/carbon. Carbon composite plates include carbon fibers in a resin matrix. Carbon/carbon replaces the resin with carbon deposited by a process such as chemical vapor deposition. Fabrication of the carbon/carbon plates is disclosed in U.S. Ser. No. 08/601,754 filed on Apr. 12, 1996, assigned to the assignee of the present invention, and incorporated herein by reference.

The spacers, 16, which can be bonded to the plates 12 and 14, are made of a material that is electrically non-conductive. The non-conductivity of the spacers 16 allows a high voltage (but very low current) to be applied to the heat exchanger 10. The voltage creates a controllable electric field across the heat exchanger 10. The electric field affects the fluids flowing through the passageways 18 and 20 and provides greater heat transfer from the hot fluid to the coolant. Resulting from the electric field is an electro-hydrodynamically enhanced heat exchanger 10.

Figure 2:
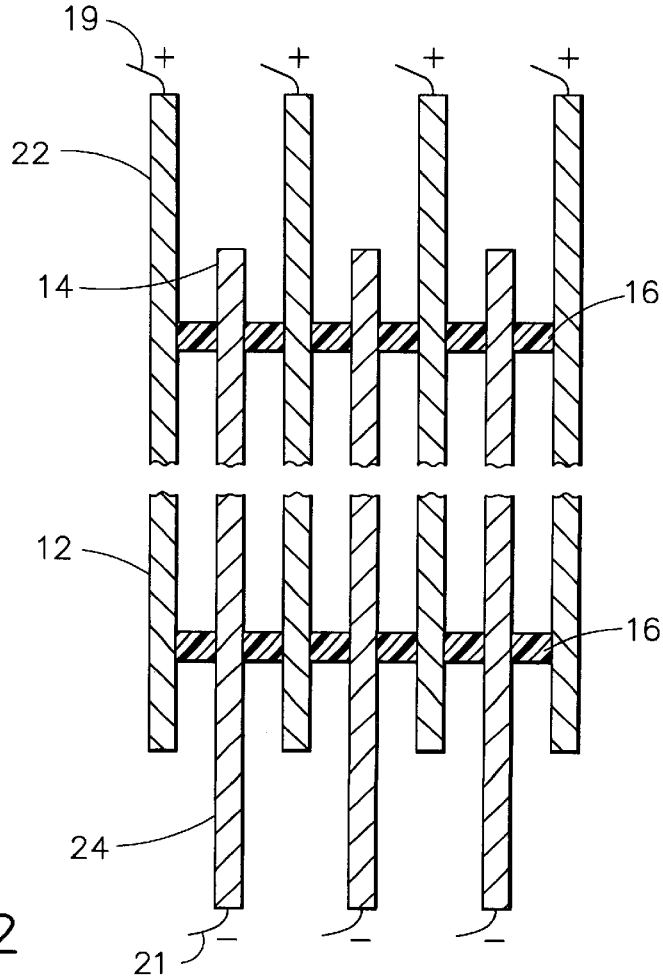
FIG. 2 is a schematic diagram of the heat exchanger while a voltage is being applied thereto.

The voltage can be applied to the plates 12 and 14 by electrical conductors 19 and 21 in such a manner that opposing plates 12 and 14 form anode-cathode pairs (see FIG. 2). That is, for each pair of opposing plates, one of the opposing plates 12 collects a positive charge when the voltage is applied, and the other of the opposing plates 14 collects a negative charge when the voltage is applied. The spacers 16 provide electrical insulation between the plates 12 and 14.

The voltage can be applied to edges of the plates 12 and 14. To make it easier to apply the voltage, the plates 12 collecting the positive charge can have fins 22 extending from one side of the heat exchanger 10, and the plates 14 accumulating the negative charge can have fins 24 extending from an opposite side of the heat exchanger 10.

The hot fluid circulated through the hot-side passageways 18 and the coolant circulated through the cold-side passageways 20 are also electrically non-conductive. The coolant, for example, can be a two-phase refrigerant.

The strength of the electric field depends partly upon the dielectric properties of the hot fluid and the coolant and partly upon the spacing between the plates 12 and 14. As the voltage is increased, the electro-hydrodynamic effect will be increased. However, the voltage cannot be so high as to cause a dielectric breakdown.

A hot-side inlet manifold (not shown) is provided to distribute the hot fluid to the hot-side passageways 18, and a hot-side outlet manifold (not shown) is provided to collect the fluid leaving the hot-side passageways 18. A cold-side inlet manifold (not shown) is provided to distribute the coolant to the cold-side passageways 20, and a cold-side outlet manifold (not shown) is provided to collect the fluid leaving the cold-side passageways 20. A manifold arrangement is disclosed in U.S. Ser. No. 08/980,122 filed on Nov. 26, 1997, assigned to the assignee of the present invention and incorporated herein by reference.

Figure 3:
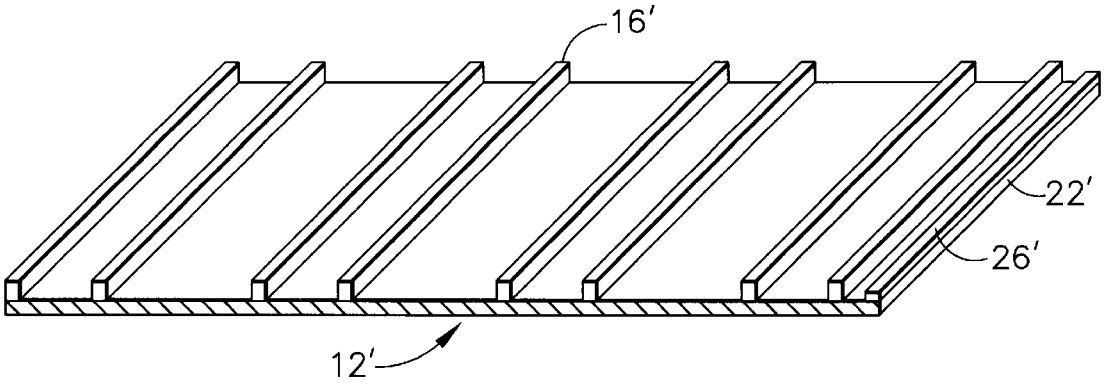
FIG. 3 is an illustration of a carbon/carbon plate for a composite heat exchanger according to the present invention.

FIG. 3 shows a carbon/carbon plate 12' and spacers 16' for a composite heat exchanger. The carbon/carbon plate 12' might be anisotropic or isotropic, depending upon how its carbon fibers are oriented. The plate 12' is conductive along the direction of the fibers. Isotropic materials are conductive along all three orthogonal axes (x, y and z) while anisotropic materials may have different conductivities along the three axes. If the plate 12' has carbon fibers are oriented in a single direction, heat flow and electrical conductivity in the plate 12' will be unidirectional.

For a carbon/carbon plate 12' having fibers oriented in a single direction, an electrode 26' traversing the fibers is attached to the fin 22'. The electrode 26' receives the voltage and distributes the voltage to the fibers in the plate 12'. For example, the electrode 26' could extend along the y-axis for carbon fibers oriented along the z-axis. The electrode 26' could have a lower profile than the spacers 16'.

The spacers 16' could be made of a high electrical resistance or insulating material such as fiberglass or a ceramic. In the alternative, the spacers 16' could be made of an electrically non-conductive carbon. Spacers 16' made of non-conductive carbon could be formed integrally with the carbon/carbon plate 12'.

Figure 4:
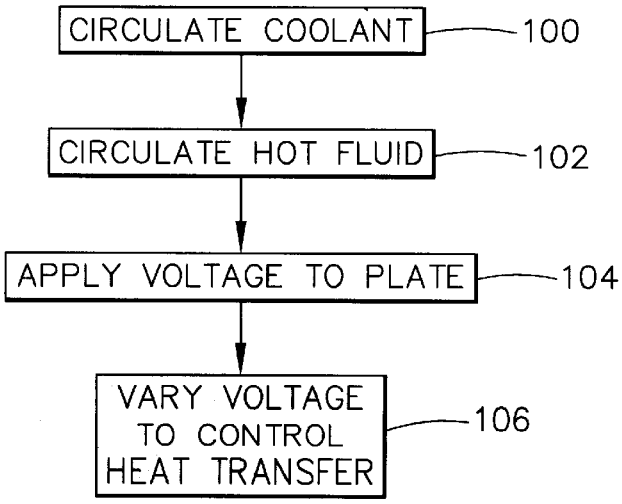
FIG. 4 is a method of operating a heat exchanger according to the present invention.

FIG. 4 shows the operation of the heat exchanger. A coolant is circulated through the cold-side passages 20 (block 100), and a hot fluid is circulated through the hot-side passages 18 (block 102). When a voltage is applied to the plates 12 and 14 (block 104). the resulting electric field across the plates 12 and 14 causes an increase in the efficiency of the heat exchanger 10. Efficiency of the heat exchanger 10 and, therefore, heat transfer can be controlled by varying the voltage (block 106).

Thus disclosed is a heat exchanger that can be electro-hydrodynamically enhanced. Electro-hydrodynamic enhancement can increase the heat transfer efficiency of the heat exchanger. Resulting can be a smaller, lighter heat exchanger.

The heat exchanger can be made of composite materials. Composite heat exchangers offer certain advantages over metal heat exchangers. Composite heat exchangers offer better corrosion resistance, lower thermal stress and, therefore, a longer operating life.

Heat transfer efficiency of the electro-hydrodynamically enhanced heat exchanger can be controlled by varying the voltage applied to the plates. This could eliminate the need for flow control valves and other mechanical flow regulators.

The invention is not limited to the specific embodiments described above. For example, the heat exchanger may have a cylindrical, circular or conical configuration. The plates may be made of metal, carbon/carbon or any other material having high thermal and electrical conductivity. The number of plates, spacers and passageways would be selected and sized to provide the required heat transfer or exchange capability for the intended application. Surface enhancements of the plates may be made to further increase turbulence of the hot fluid and/or the coolant. The surface enhancements might take the form of perforations, artificial roughness or louvers.

Thus, the invention is not limited to the specific embodiments described above. Instead, the invention is to be construed according to the claims that follow.

We claim:

1. A heat exchanger comprising:

a plurality of carbon-carbon plates stacked in a substantially parallel spaced-apart relationship, the plates being thermally and electrically conductive; and a plurality of electrically non-conductive carbon spacers located between the plates;

the spacers and the plates cooperating to define hot-side and cold-side passageways.

2. The heat exchanger of claim 1, wherein the plates include conductive fibers oriented in a single direction, and wherein the heat exchanger further comprises a plurality of fiber-traversing electrodes attached to the plates.

3. The heat exchanger of claim 1, wherein odd-numbered plates have fins extending from one side of the heat exchanger, and wherein even-numbered plates have fins extending from a different side of the heat exchanger.

4. The heat exchanger of claim 1, further comprising means for applying a controllable voltage to the plates.

5. The heat exchanger of claim 4, wherein opposing plates form anode-cathode pairs when the voltage is applied.

6. The heat exchanger of claim 1, further comprising electrically non-conductive fluids for the hot-side and cold-side passageways.

7. The heat exchanger of claim 1, wherein the non-conductive carbon spacers are integral with the plates.

8. A heat exchanger comprising:

a plurality of carbon-carbon plates stacked in a substantially parallel spaced-apart relationship, the plates including electrically conductive fibers;

a plurality of fiber-traversing conductive electrodes attached to ends of the plates; and a plurality of electrically non-conductive spacers located between the plates, the spacers electrically isolating the plates;

the spacers and the plates cooperating to define hot-side and cold-side passageways.

9. The heat exchanger of claim 8, wherein odd-numbered plates form fins extending from one side of the heat exchanger, and wherein even-numbered plates form fins extending from a different side of the heat exchanger.

10. The heat exchanger of claim 8, further comprising means for applying a controllable voltage to the plates.

11. The heat exchanger of claim 10, wherein opposing plates form anodecathode pairs when the voltage is applied.

12. The heat exchanger of claim 8, further comprising electrically non-conductive fluids for the hot-side and cold-side passageways.

13. The heat exchanger of claim 8, wherein the spacers are made of electrically non-conductive carbon, and wherein the non-conductive carbon spacers are integral with the plates.

14. A heat exchanger comprising:

a plurality of carbon composite plates stacked in a substantially parallel spaced-apart relationship, the plates being thermally and electrically conductive; and a plurality of electrically non-conductive carbon spacers located between the plates;

the spacers and the plates cooperating to define hot-side and cold-side passageways.

15. The heat exchanger of claim 14, wherein the non-conductive carbon spacers are integral with the plates.

* * * * *